US007115016B2

(12) United States Patent
Chandrasekaran

(10) Patent No.: US 7,115,016 B2
(45) Date of Patent: Oct. 3, 2006

(54) APPARATUS AND METHOD FOR MECHANICAL AND/OR CHEMICAL-MECHANICAL PLANARIZATION OF MICRO-DEVICE WORKPIECES

(75) Inventor: Nagasubramaniyan Chandrasekaran, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/293,419

(22) Filed: Dec. 1, 2005

(65) Prior Publication Data

US 2006/0073767 A1 Apr. 6, 2006

Related U.S. Application Data

(62) Division of application No. 10/230,667, filed on Aug. 29, 2002.

(51) Int. Cl.
*B24B 49/00* (2006.01)
*B24B 7/02* (2006.01)

(52) U.S. Cl. ..... 451/5; 451/285; 451/165

(58) Field of Classification Search ..... 451/5, 451/41, 36, 285–289, 165, 446
See application file for complete search history.

(56) References Cited

U.S. PATENT DOCUMENTS 5,036,015 A 7/1991 Sandhu et al.
5,069,002 A 12/1991 Sandhu et al.
5,081,796 A 1/1992 Schultz
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,404,680 A * 4/1995 Mizuguchi et al. ..... 451/36
5,413,941 A 5/1995 Koos et al.
5,421,769 A 6/1995 Schultz et al.
5,433,651 A 7/1995 Lustig et al.
5,439,551 A 8/1995 Meikle et al.
5,449,314 A 9/1995 Meikle et al.

(Continued)

OTHER PUBLICATIONS

Kondo, S. et al., "Abrasive-Free Polishing for Copper Damascene Interconnection", Journal of the Electrochemical Society, 147 (10) pp. 3907-3913 (2000).

*Primary Examiner*—Hadi Shakeri
(74) *Attorney, Agent, or Firm*—Perkins Coie LLP

(57) ABSTRACT

Planarizing machines and methods for mechanical and/or chemical-mechanical planarization of micro-device workpieces are disclosed herein. In one embodiment, a method for polishing a workpiece includes determining an estimated frequency of serial defects in a workpiece, pressing the workpiece against a polishing pad and moving the workpiece relative to the pad. The method further includes vibrating the workpiece and/or the pad at a frequency that is greater than the estimated frequency of the serial defects. In one aspect of this embodiment, determining the estimated frequency of serial defects can include: determining a relative velocity between the workpiece and the polishing pad; estimating the length of a mark on the workpiece; estimating the time a particle in a planarizing solution is in contact with the workpiece; and estimating the number of cracks in the workpiece.

24 Claims, 4 Drawing Sheets

U.S. PATENT DOCUMENTS

| | | | | |
|---|---|---|---|---|
| 5,486,129 | A | | 1/1996 | Sandhu et al. |
| 5,514,245 | A | | 5/1996 | Doan et al. |
| 5,533,924 | A | | 7/1996 | Stroupe et al. |
| 5,540,810 | A | | 7/1996 | Sandhu et al. |
| 5,616,069 | A | | 4/1997 | Walker et al. |
| 5,618,381 | A | | 4/1997 | Doan et al. |
| 5,643,048 | A | | 7/1997 | Iyer |
| 5,643,060 | A | | 7/1997 | Sandhu et al. |
| 5,645,682 | A | | 7/1997 | Skrovan |
| 5,655,951 | A | | 8/1997 | Meikle et al. |
| 5,658,183 | A | | 8/1997 | Sandhu et al. |
| 5,658,190 | A | | 8/1997 | Wright et al. |
| 5,663,797 | A | | 9/1997 | Sandhu |
| 5,664,988 | A | | 9/1997 | Stroupe et al. |
| 5,679,065 | A | | 10/1997 | Henderson |
| 5,688,364 | A | * | 11/1997 | Sato ..... 451/165 |
| 5,702,292 | A | | 12/1997 | Brunelli et al. |
| 5,725,417 | A | | 3/1998 | Robinson |
| 5,730,642 | A | | 3/1998 | Sandhu et al. |
| 5,738,562 | A | | 4/1998 | Doan et al. |
| 5,747,386 | A | | 5/1998 | Moore |
| 5,777,739 | A | | 7/1998 | Sandhu et al. |
| 5,779,522 | A | | 7/1998 | Walker et al. |
| 5,782,675 | A | | 7/1998 | Southwick |
| 5,792,709 | A | | 8/1998 | Robinson et al. |
| 5,795,495 | A | | 8/1998 | Meikle |
| 5,798,302 | A | | 8/1998 | Hudson et al. |
| 5,801,066 | A | | 9/1998 | Meikle |
| 5,807,165 | A | | 9/1998 | Uzoh et al. |
| 5,830,806 | A | | 11/1998 | Hudson et al. |
| 5,833,519 | A | | 11/1998 | Moore |
| 5,846,336 | A | | 12/1998 | Skrovan |
| 5,851,135 | A | | 12/1998 | Sandhu et al. |
| 5,855,804 | A | | 1/1999 | Walker |
| 5,868,896 | A | | 2/1999 | Robinson et al. |
| 5,879,226 | A | | 3/1999 | Robinson |
| 5,882,248 | A | | 3/1999 | Wright et al. |
| 5,893,754 | A | | 4/1999 | Robinson et al. |
| 5,895,550 | A | | 4/1999 | Andreas |
| 5,910,043 | A | | 6/1999 | Manzonie et al. |
| 5,910,846 | A | | 6/1999 | Sandhu |
| 5,930,699 | A | | 7/1999 | Bhatia |
| 5,934,980 | A | | 8/1999 | Koos et al. |
| 5,936,733 | A | | 8/1999 | Sandhu et al. |
| 5,945,347 | A | | 8/1999 | Wright |
| 5,954,912 | A | | 9/1999 | Moore |
| 5,967,030 | A | | 10/1999 | Blalock |
| 5,972,792 | A | | 10/1999 | Hudson |
| 5,975,994 | A | | 11/1999 | Sandhu et al. |
| 5,980,363 | A | | 11/1999 | Meikle et al. |
| 5,981,396 | A | | 11/1999 | Robinson et al. |
| 5,994,224 | A | | 11/1999 | Sandhu et al. |
| 5,997,384 | A | | 12/1999 | Blalock |
| 6,004,196 | A | | 12/1999 | Doan et al. |
| 6,007,408 | A | | 12/1999 | Sandhu |
| 6,039,633 | A | | 3/2000 | Chopra |
| 6,040,245 | A | | 3/2000 | Sandhu et al. |
| 6,046,111 | A | | 4/2000 | Robinson |
| 6,054,015 | A | | 4/2000 | Brunelli et al. |
| 6,057,602 | A | | 5/2000 | Hudson et al. |
| 6,066,030 | A | | 5/2000 | Uzoh |
| 6,074,286 | A | | 6/2000 | Ball |
| 6,083,085 | A | | 7/2000 | Lankford |
| 6,108,092 | A | | 8/2000 | Sandhu |
| 6,110,820 | A | | 8/2000 | Sandhu et al. |
| 6,116,988 | A | | 9/2000 | Ball |
| 6,120,354 | A | | 9/2000 | Koos et al. |
| 6,135,856 | A | | 10/2000 | Tjaden et al. |
| 6,139,402 | A | | 10/2000 | Moore |
| 6,143,123 | A | | 11/2000 | Robinson et al. |
| 6,143,155 | A | | 11/2000 | Adams et al. |
| 6,152,808 | A | | 11/2000 | Moore |
| 6,176,992 | B1 | | 1/2001 | Talieh |
| 6,180,525 | B1 | | 1/2001 | Morgan |
| 6,184,571 | B1 | | 2/2001 | Moore |
| 6,187,681 | B1 | | 2/2001 | Moore |
| 6,190,494 | B1 | | 2/2001 | Dow |
| 6,191,037 | B1 | | 2/2001 | Robinson et al. |
| 6,191,864 | B1 | | 2/2001 | Sandhu |
| 6,193,588 | B1 | | 2/2001 | Carlson et al. |
| 6,196,899 | B1 | | 3/2001 | Chopra et al. |
| 6,200,901 | B1 | | 3/2001 | Hudson et al. |
| 6,203,404 | B1 | | 3/2001 | Joslyn et al. |
| 6,203,413 | B1 | | 3/2001 | Skrovan |
| 6,206,754 | B1 | | 3/2001 | Moore |
| 6,206,756 | B1 | | 3/2001 | Chopra et al. |
| 6,206,769 | B1 | | 3/2001 | Walker |
| 6,208,425 | B1 | | 3/2001 | Sandhu et al. |
| 6,210,257 | B1 | | 4/2001 | Carlson |
| 6,213,845 | B1 | | 4/2001 | Elledge |
| 6,218,316 | B1 | | 4/2001 | Marsh |
| 6,220,934 | B1 | | 4/2001 | Sharples et al. |
| 6,227,955 | B1 | | 5/2001 | Custer et al. |
| 6,234,874 | B1 | | 5/2001 | Ball |
| 6,234,877 | B1 | | 5/2001 | Koos et al. |
| 6,234,878 | B1 | | 5/2001 | Moore |
| 6,237,483 | B1 | | 5/2001 | Blalock |
| 6,238,270 | B1 | | 5/2001 | Robinson |
| 6,250,994 | B1 | | 6/2001 | Chopra et al. |
| 6,251,785 | B1 | | 6/2001 | Wright |
| 6,261,151 | B1 | | 7/2001 | Sandhu et al. |
| 6,261,163 | B1 | | 7/2001 | Walker et al. |
| 6,267,650 | B1 | | 7/2001 | Hembree |
| 6,273,786 | B1 | | 8/2001 | Chopra et al. |
| 6,273,796 | B1 | | 8/2001 | Moore |
| 6,273,800 | B1 | | 8/2001 | Walker et al. |
| 6,276,996 | B1 | | 8/2001 | Chopra |
| 6,284,660 | B1 | | 9/2001 | Doan |
| 6,287,879 | B1 | | 9/2001 | Gonzales et al. |
| 6,290,572 | B1 | | 9/2001 | Hofmann |
| 6,301,006 | B1 | | 10/2001 | Doan |
| 6,306,008 | B1 | | 10/2001 | Moore |
| 6,306,012 | B1 | | 10/2001 | Sabde |
| 6,306,014 | B1 | | 10/2001 | Walker et al. |
| 6,306,768 | B1 | | 10/2001 | Klein |
| 6,312,558 | B1 | | 11/2001 | Moore |
| 6,319,420 | B1 | | 11/2001 | Dow |
| 6,323,046 | B1 | | 11/2001 | Agarwal |
| 6,328,632 | B1 | | 12/2001 | Chopra |
| 6,331,139 | B1 | | 12/2001 | Walker et al. |
| 6,331,488 | B1 | | 12/2001 | Doan et al. |
| 6,350,180 | B1 | | 2/2002 | Southwick |
| 6,350,691 | B1 | | 2/2002 | Lankford |
| 6,352,466 | B1 | | 3/2002 | Moore |
| 6,352,470 | B1 | | 3/2002 | Elledge |
| 6,354,923 | B1 | | 3/2002 | Lankford |
| 6,354,930 | B1 | | 3/2002 | Moore |
| 6,358,122 | B1 | | 3/2002 | Sabde et al. |
| 6,358,127 | B1 | | 3/2002 | Carlson et al. |
| 6,358,129 | B1 | | 3/2002 | Dow |
| 6,361,411 | B1 | | 3/2002 | Chopra et al. |
| 6,361,413 | B1 | | 3/2002 | Skrovan |
| 6,361,417 | B1 | | 3/2002 | Walker et al. |
| 6,362,105 | B1 | | 3/2002 | Moore |
| 6,364,746 | B1 | | 4/2002 | Moore |
| 6,364,757 | B1 | | 4/2002 | Moore |
| 6,368,190 | B1 | | 4/2002 | Easter et al. |
| 6,368,193 | B1 | | 4/2002 | Carlson et al. |
| 6,368,194 | B1 | | 4/2002 | Sharples et al. |
| 6,368,197 | B1 | | 4/2002 | Elledge |
| 6,376,381 | B1 | | 4/2002 | Sabde |
| 6,413,873 | B1 | | 7/2002 | Li et al. |
| 6,424,137 | B1 | | 7/2002 | Sampson |

6,585,562 B1 * 7/2003 Gitis et al. ..... 451/5
6,585,570 B1 7/2003 Kim et al.
6,666,749 B1 12/2003 Taylor
2004/0043699 A1 3/2004 Chandrasekaran

* cited by examiner

APPARATUS AND METHOD FOR MECHANICAL AND/OR CHEMICAL-MECHANICAL PLANARIZATION OF MICRO-DEVICE WORKPIECES

CROSS-REFERENCE TO RELATED APPLICATION

This application is a divisional of U.S. patent application Ser. No. 10/230,667, filed Aug. 29, 2002, which is incorporated herein by reference in its entirety.

TECHNICAL FIELD

The present invention relates to polishing and planarizing micro-device workpieces, including mechanical and chemical-mechanical planarization. In particular, the present invention relates to mechanical and/or chemical-mechanical planarization of micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow 1).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42.

One drawback to conventional CMP machines is that the abrasive particles in the planarizing solution often scratch the surface of the micro-device workpiece during the CMP process. Abrasive particles typically abrade the surface of the micro-device workpiece to remove material during planarization. However, some abrasions are relatively deep scratches that can induce cracks and subsequent fractures in a brittle micro-device workpiece. Furthermore, abrasive particles can slide on the surface of the workpiece creating stress that exceeds the critical limit of the workpiece material, and consequently causes cracks. Such cracks and material fracture can cause failure in the microelectronic devices that are formed from the micro-device workpiece. Accordingly, there is a significant need to reduce the brittle failure (e.g., cracks and fractures) in the micro-device workpiece.

SUMMARY

The present invention is directed to planarizing machines and methods for mechanical and/or chemical-mechanical planarization of micro-device workpieces. In one embodiment, a method for polishing a micro-device workpiece includes determining an estimated frequency of serial defects in a workpiece pressed against a polishing pad, and moving the workpiece relative to the polishing pad. The method further includes vibrating the workpiece and/or the polishing pad at a frequency greater than the estimated frequency of the serial defects in the workpiece. In one aspect of this embodiment, determining the estimated frequency of serial defects can include any of the following: determining a relative velocity between the workpiece and the polishing pad at a point on the workpiece; determining the length of a mark on the workpiece; calculating an estimate of the time a particle in a planarizing solution is in contact with the workpiece; and estimating the number of cracks in the mark on the workpiece. In a further aspect of this embodiment, a transducer can vibrate the workpiece and/or the polishing pad. The transducer can be positioned in the carrier head, proximate to the polishing pad, or in an actuator assembly. In another aspect of this embodiment, vibrating the workpiece and/or the polishing pad can include vibrating the workpiece at an ultrasonic frequency between approximately 500 kHz and 7 MHz, between approximately 1.1 and 2.0 times the estimated frequency, or at other frequencies according to the type of defects formed in a specific application.

In another embodiment of the invention, a machine for polishing a micro-device workpiece includes a carrier head, a polishing pad, and a transducer configured to produce vibration in the workpiece, the polishing pad, and/or the carrier head. The machine also includes a controller operatively coupled to the carrier head, the polishing pad, and the transducer. The controller has a computer-readable medium containing instructions to perform any of the above-mentioned methods.

DETAILED DESCRIPTION

The present invention is directed toward polishing machines and methods for mechanical and/or chemical-mechanical planarization of micro-device workpieces. The term "micro-device workpiece" is used throughout to include substrates upon which and/or in which microelectronic devices, micromechanical devices, data storage elements, and other features are fabricated. For example, micro-device workpieces can be semiconductor wafers, glass substrates, insulative substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–7 to provide a thorough understanding of certain embodiments of the invention. One skilled in the art, however, will understand that the present invention may have additional embodiments, or that other embodiments of the invention may be practiced without several of the specific features explained in the following description.

Figure 1:
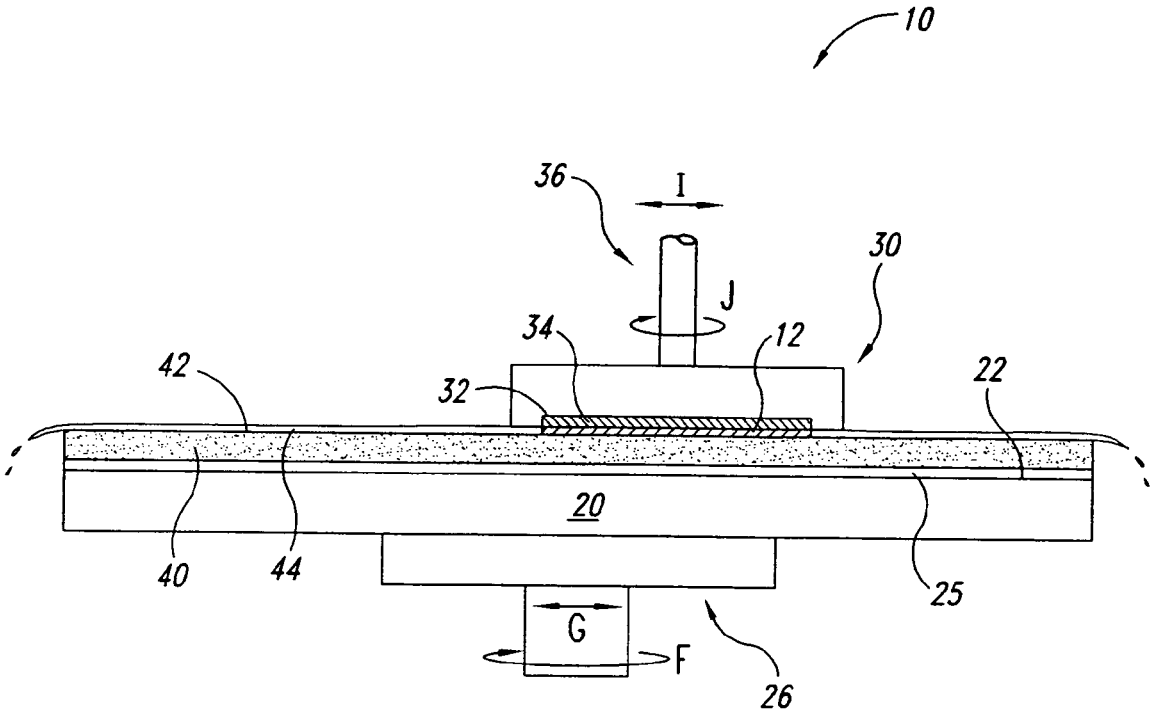
Fig. 1 (Prior Art)
FIG. 1 is a schematic view of a rotary CMP machine with a platen, a carrier head, and a planarizing pad in accordance with the prior art.
Figure 2:
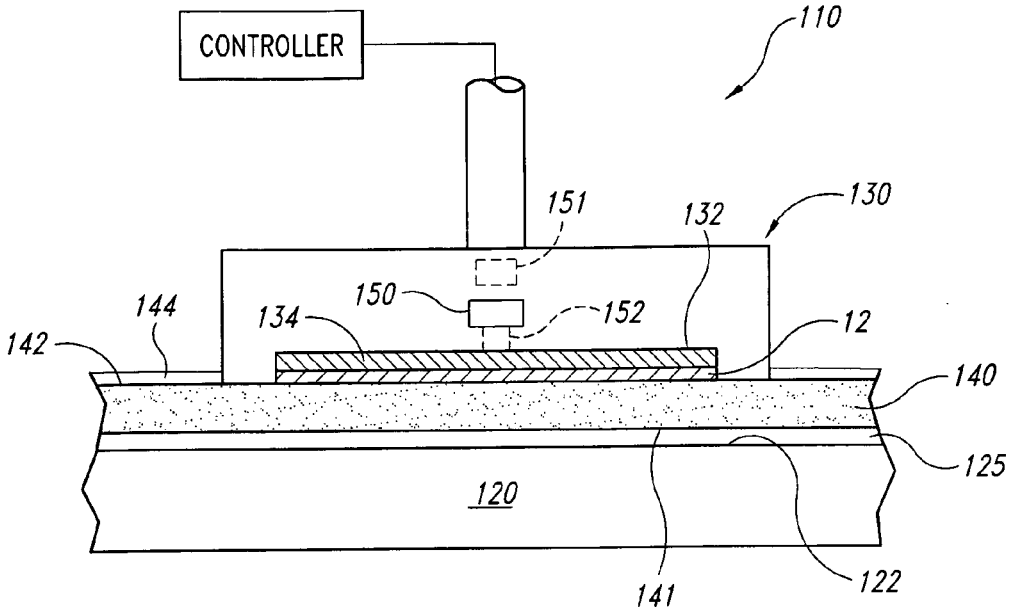
FIG. 2 is a schematic view of a rotary CMP machine with a platen, a carrier head, and a planarizing pad in accordance with one embodiment of the invention.

FIG. 2 is a schematic view of a rotary CMP machine 110 with a platen 120, a carrier head 130, and a planarizing pad 140 in accordance with one embodiment of the invention. The CMP machine 110 may also have an under-pad 125 between an upper surface 122 of the platen 120 and a lower surface 141 of the planarizing pad 140. In the illustrated embodiment, the carrier head 130 includes a resilient pad 134 under a lower surface 132 and a transducer 150 above the lower surface 132. A micro-device workpiece 12 can be attached to the resilient pad 134, or in other embodiments, the micro-device workpiece 12 can be attached to the lower surface 132. The transducer 150 can be a mechanical, vibrating transducer, such as a piezoelectric transducer, that produces motion during planarization of the micro-device workpiece 12. In one embodiment, the transducer 150 vibrates the entire carrier head 130, and the micro-device workpiece 12 accordingly vibrates with the carrier head 130. In other embodiments, a rod 152 (shown in broken lines) operatively couples the transducer 150 to the resilient pad 134 and/or the micro-device workpiece 12 to vibrate the workpiece 12. In a further aspect of these embodiments, the carrier head 130 can include a damper 151 (shown in broken lines) to reduce movement of the carrier head 130 while the rod 152 vibrates the micro-device workpiece 12. The damper 151 can be a bladder, foam, or other device to dampen the movement of the carrier head 130. Vibrating the micro-device workpiece 12 during planarization reduces the serial defects in the workpiece 12, such as the marks and/or cracks, as described in detail below.

The planarizing pad 140 and a planarizing solution 144 define a planarizing medium that mechanically and/or chemically-mechanically removes material from the surface of the micro-device workpiece 12. In the illustrated embodiment, the planarizing solution 144 is a conventional CMP slurry with abrasive particles and chemicals that etch and/or oxidize the surface of the micro-device workpiece 12. To planarize the micro-device workpiece 12 with the CMP machine 110, the carrier head 130 presses the workpiece 12 face-down against the planarizing pad 140. More specifically, the carrier head 130 generally presses the micro-device workpiece 12 against the planarizing solution 144 on a planarizing surface 142 of the planarizing pad 140, and the platen 120 and/or the carrier head 130 moves to rub the workpiece 12 against the planarizing surface 142.

Figure 3:
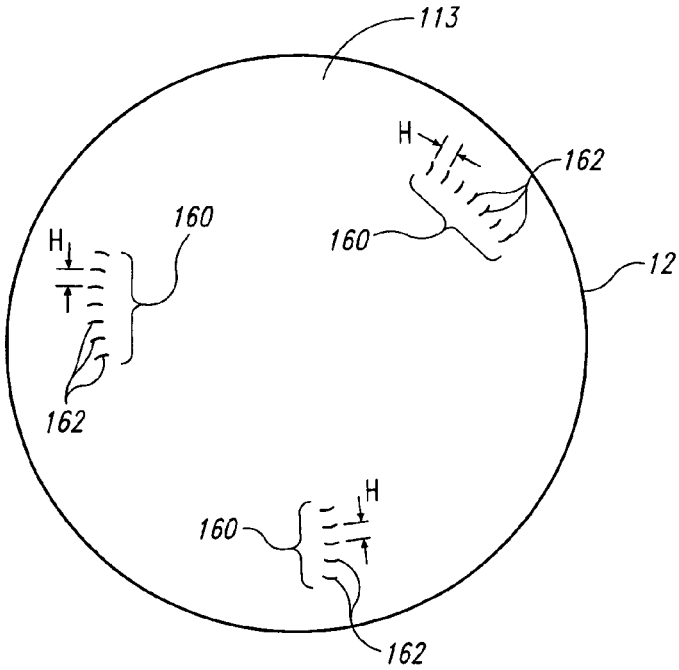
FIG. 3 is a schematic top view of the micro-device workpiece after planarization.

FIG. 3 is a schematic top view of the micro-device workpiece 12 after planarization. The micro-device workpiece 12 of the illustrated embodiment has a plurality of marks 160 on a planarized surface 113. Each mark 160 has a plurality of cracks 162 separated by uniform gaps H. The cracks 162 can appear like ripples with uniform spacing and a similar radius of curvature along a common track. As described above, the abrasive particles in the planarizing solution typically move across the surface 113 of the micro-device workpiece 12 to remove material during planarization. When the abrasive particles slide across the workpiece 12, they can induce stresses that form a series of cracks 162 in the surface of the micro-device workpiece 12. In other instances, the marks 160 may be deep scratches that induce the stresses which produce the cracks 162. In one embodiment, at least some of the marks 160 can be approximately 1 to 2 μm in length. In other embodiments, at least some of the marks 160 can be shorter than 1 μm or longer than 2 μm. It has been observed that a 1 μm mark 160 can have from approximately 2 to 4 cracks 162. In other embodiments, the number of marks 162 and the length of the marks 160 may vary.

Referring to FIGS. 2 and 3, the general knowledge of the art before the present invention understood that the marks 160 and the associated cracks 162 were caused by abrasive particles in the planarizing solution 144 rolling or tumbling during planarization. The present inventor, however, hypothesizes that at least some of the cracks 162 are caused by abrasive particles that are at least temporarily trapped between the planarizing pad 140 and the micro-device workpiece 12. As the planarizing pad 140 and the micro-device workpiece 12 move relative to each other during planarization, the trapped abrasive particles either slide or scratch the surface. Depending on the size of the abrasive particles, friction, velocity, pad roughness, abrasive type, and work type, stress contours are generated on the surface and extend into the matrix of the workpiece. The stress contours can lead to hyperbolic or cone-shaped cracks that are arranged in a "ripple" of cracks across the workpiece. The depth of the cracks in the matrix and the configuration of the cracks is a function of several factors, such as the induced stress, relative velocity, and types of materials. In general, the cracks propagate across the workpiece surface in the direction of the relative motion between the abrasive particle and the workpiece, but the cracks propagate through the matrix of the workpiece in a direction opposite to such relative motion. When the stress in the micro-device workpiece 12 reaches a critical level, it is released in the form of a crack 162. If the abrasive particle remains trapped, the stress begins to increase again and the cycle is repeated on a periodic basis. The gap H between cracks 162 and the curvature of the cracks can be a function of the micro-device workpiece material, the particle material, the particle configuration, the relative velocity between the planarizing pad 140 and the micro-device workpiece 12, and the load on the micro-device workpiece 12. Accordingly, the size of each gap H can be different.

In the illustrated embodiment, the transducer 150 vibrates the micro-device workpiece 12 to temporarily separate the workpiece 12 from the trapped abrasive particles before the stress reaches the critical level and causes cracks 162 in the micro-device workpiece 12. In other embodiments, such as those described with reference to FIGS. 5–7, the transducer can vibrate the carrier head 130 or the planarizing pad 140 to temporarily separate the workpiece 12 from the trapped abrasive particles. In most applications, the transducer operates at ultrasonic frequencies. In one embodiment, an estimated frequency of cracks $f_e$ can be determined and the transducer 150 can vibrate the micro-device workpiece 12 and/or the planarizing pad 140 at a frequency greater than the estimated frequency $f_e$ to temporarily separate the workpiece 12 from the trapped abrasive particles before they cause cracks 162 in the micro-device workpiece 12. Thus, to determine the frequency for operating the transducer 150, several embodiments of the invention first determine the estimated frequency of cracks $f_e$ on workpieces planarized under similar conditions.

Figure 4:
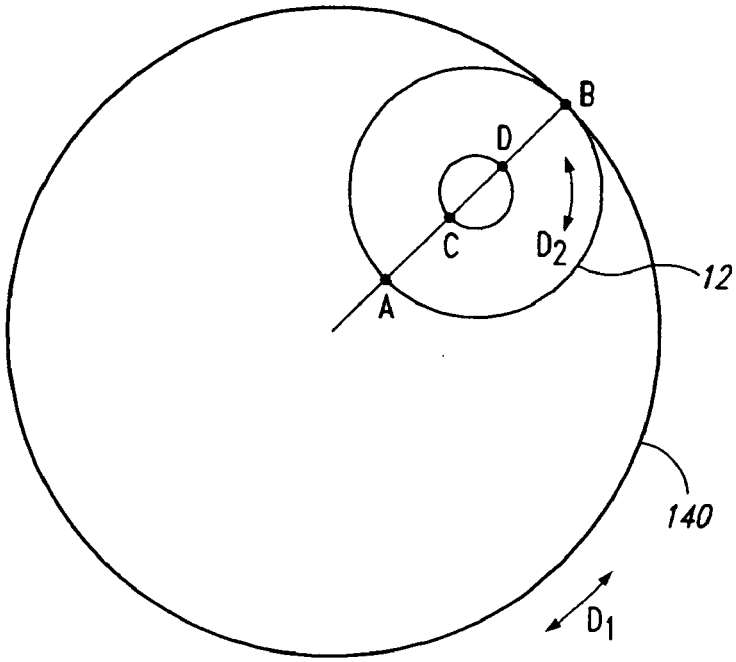
FIG. 4 is a schematic top view of the micro-device workpiece and the planarizing pad having reference points A, B, C, and D for calculating the estimated frequency of cracks in accordance with one embodiment of the invention.

FIG. 4 is a schematic top view of the micro-device workpiece 12 and the planarizing pad 140 having reference points A, B, C, and D for calculating the estimated frequency of cracks $f_e$ in accordance with one embodiment of the invention. It will be appreciated that the following is only a model calculation for purposes of example. Point A is approximately 1 inch from the center of the planarizing pad 140 and 100 μm from the center of the micro-device workpiece 12. Point B is approximately 10 inches from the center of the planarizing pad 140 and 100 μm from the center of the micro-device workpiece 12. To determine the estimated frequency of cracks $f_e$, first, the relative velocities between the planarizing pad 140 and the micro-device workpiece 12 at points A and B are calculated. The velocity V at a radius r can be calculated according to the following formula:

$$V=2\pi rN$$

where N is the rotational velocity. Assuming the planarizing pad 140 rotates in a direction $D_1$ at 30 rpm, the velocities at points A and B on the planarizing pad 140 are approximately 0.08 m/s and 0.8 m/s, respectively. Assuming the micro-device workpiece 12 rotates in a direction $D_2$ at 30 rpm, the velocity of the micro-device workpiece 12 at points A and B is approximately 0.314 m/s. Therefore, the relative velocities between the planarizing pad 140 and the micro-device workpiece 12 at points A and B are 0.394 m/s and 0.486 m/s, respectively. The relative velocities at point C, which is 1 μm from the center of the micro-device workpiece 12 and approximately 4 inches from the center of the planarizing pad 140, and point D, which is 1 μm from the center of the micro-device workpiece 12 and approximately 6 inches from the center of the planarizing pad 140, can be similarly calculated. Accordingly, the relative velocities at points C and D are 0.317 m/s and 0.453 m/s, respectively. In other embodiments, other reference points on the micro-device workpiece 12 can be used to determine the estimated frequency of cracks $f_e$.

Next, the time T an abrasive particle is in contact with the micro-device workpiece 12 at each reference point A, B, C, and D can be determined by the following formula:

$$T = \frac{L}{V_r}$$

where L is the length of the mark at each reference point A, B, C, and D and $V_r$ is the relative velocity between the micro-device workpiece 12 and the planarizing pad 140 at the mark. Assuming the micro-device workpiece 12 has a mark with a length of 1 μm at each reference point A, B, C, and D, the time T each particle is in contact with the micro-device workpiece 12 at each reference point A, B, C, and D is listed below:

$T_A$=2.54 microseconds
$T_B$=2.04 microseconds
$T_C$=3.15 microseconds
$T_D$=2.21 microseconds In other embodiments, other mark lengths may be used to calculate the estimated frequency of cracks $f_e$. For example, marks may have lengths greater than or less than 1 μm. In one embodiment, only the minimum and maximum contact times $T_B$ and $T_C$ are considered to determine the estimated frequency of cracks $f_e$. The estimated frequency of cracks $f_e$ can be calculated according to the following formula:

$$f_e = \frac{N_c}{T}$$

where $N_C$ is the number of cracks in the mark. In one embodiment, assuming there are 2 or 4 cracks in each mark, the estimated frequency of cracks $f_e$ at reference points B and C are listed below:

$N_C$=2 $f_{e,B}$=1.00 MHz $f_{e,C}$=0.63 MHz
$N_C$=4 $f_{e,B}$=2.00 MHz $f_{e,C}$=1.27 MHz

In this example, vibrating the micro-device workpiece 12 at a frequency higher than the highest estimated frequency of 2.00 MHz substantially eliminates the cracks that occur in the workpiece 12 during planarization. In other embodiments, the micro-device workpiece 12 may not be vibrated at a frequency higher than the highest estimated frequency. For example, the micro-device workpiece would likely not be vibrated at a frequency higher than the highest estimated frequency if vibrating the workpiece at such a frequency would not relieve stress in the micro-device workpiece sufficiently to reduce the most problematic cracking.

In additional embodiments, other mark lengths and other numbers of cracks in a mark can be used in the calculations to determine different estimated frequencies of cracks $f_e$. Accordingly, in other embodiments, micro-device workpieces may be vibrated at ultrasonic frequencies between approximately 500 kHz and 7 MHz to reduce the cracking during planarization. In additional embodiments, micro-device workpieces may be vibrated at ultrasonic frequencies that are less than 500 kHz or greater than 7 MHz, or ultrasonic frequencies that are between approximately 1.1 and 2.0 times the estimated frequency $f_e$.

The illustrated embodiment of FIGS. 2 and 3 is expected to reduce or eliminate marks 160, cracks 162, and other serial defects in the micro-device workpiece 12 that occur during planarization. For example, cracks 162 are reduced because the vibration separates the workpiece 12 from entrapped abrasive particles in the planarizing solution 144 before sufficient stress builds in the workpiece 12 to cause cracking. The vibrations accordingly avoid continuous contact between the workpiece 12 and the particles so that the stress in the workpiece 12 is kept below a critical level at which cracks form. The illustrated embodiment of FIGS. 2 and 3 is also expected to improve the transport of planarizing solution 144 and the temperature control at the interface of the planarizing pad 140 and the micro-device workpiece 12.

Figure 5:
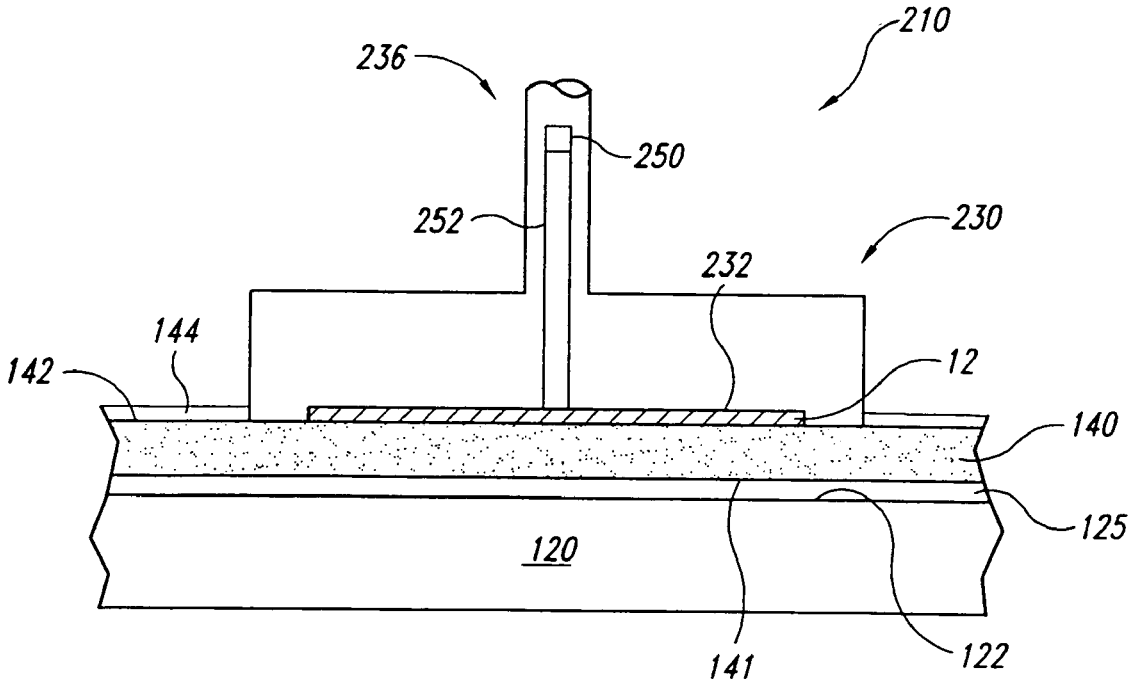
FIG. 5 is a schematic view of a rotary CMP machine in accordance with another embodiment of the invention.

FIG. 5 is a schematic view of a rotary CMP machine 210 in accordance with another embodiment of the invention. The CMP machine 210 includes the platen 120 and the planarizing pad 140 of the CMP machine 110 described above with reference to FIG. 2. The rotary CMP machine 210 also includes a carrier head 230 coupled to an actuator assembly 236 to move the carrier head 230. The carrier head 230 has a lower surface 232 to which the micro-device workpiece 12 can be attached. The actuator assembly 236 includes a transducer 250 that produces movement, such as vibration. The transducer 250 can be similar to the transducer 150 described above with reference to FIG. 2. A rod 252 extending from the transducer 250 to the lower surface 232 of the carrier head 230 can transmit the movement from the transducer 250 to the micro-device workpiece 12. In other embodiments, the transducer 250 and the rod 252 can cause the entire carrier head 230 including the micro-device workpiece 12 to vibrate.

Figure 6:
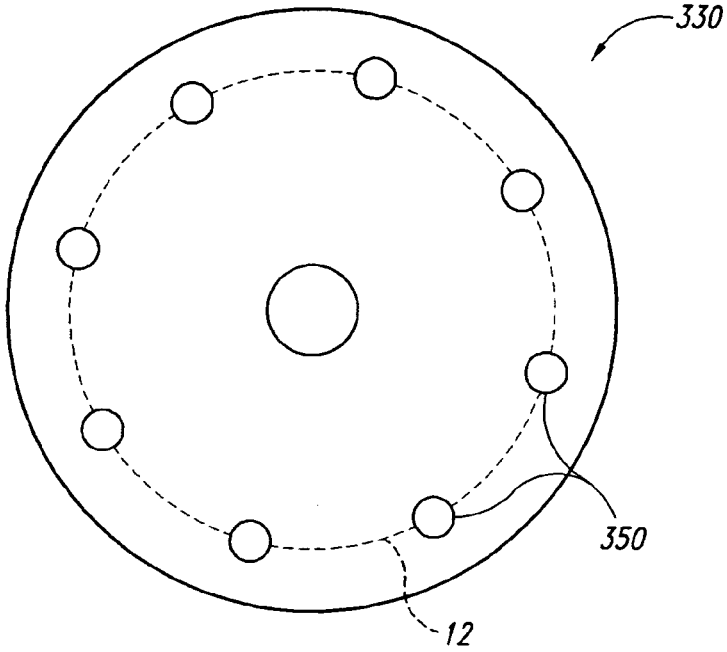
FIG. 6 is a schematic top view of a carrier head having a plurality of transducers in accordance with another embodiment of the invention.

FIG. 6 is a schematic top view of a carrier head 330 having a plurality of transducers 350 in accordance with another embodiment of the invention. In the illustrated embodiment, the transducers 350 are arranged annularly about the circumference of the micro-device workpiece 12 (shown in broken lines) proximate to the top surface of the carrier head 330. Each transducer 350 can vibrate the micro-device workpiece 12 through a rod, such as the rods described above with reference to FIGS. 2 and 5, or each transducer 350 can vibrate the entire carrier head 330 including the micro-device workpiece 12. Furthermore, the transducers 350 can vibrate at the same frequency or at different frequencies. In other embodiments, the transducers 350 can be arranged differently either on or in the carrier head 330.

Figure 7:
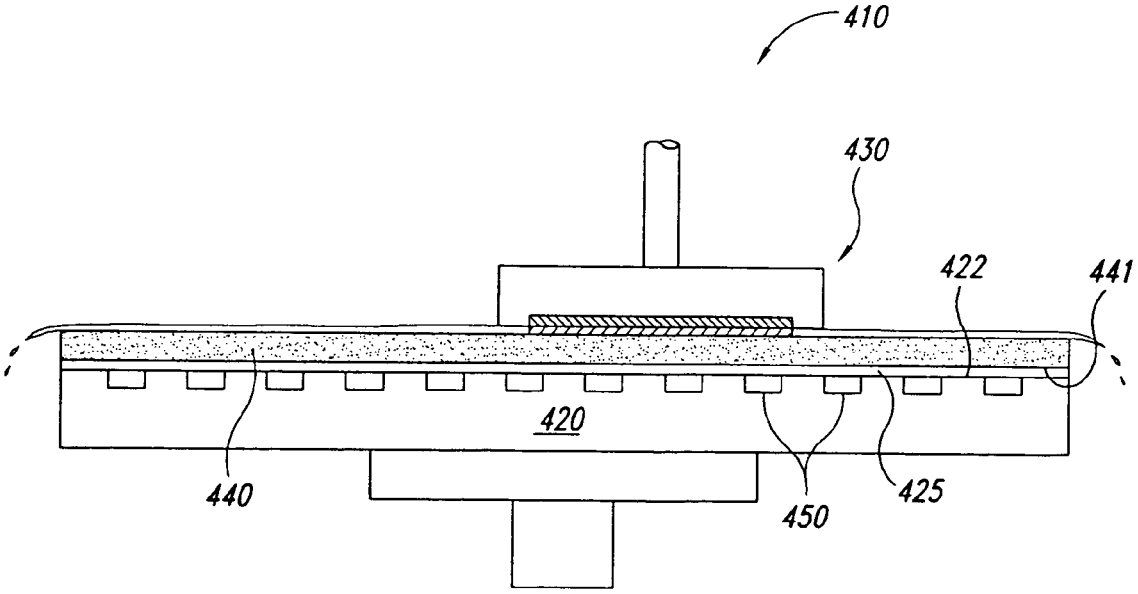
FIG. 7 is a schematic view of a CMP machine in accordance with another embodiment of the invention.

FIG. 7 is a schematic view of a CMP machine 410 in accordance with another embodiment of the invention. The CMP machine 410 includes a platen 420, a carrier head 430, and a planarizing pad 440 in accordance with another embodiment of the invention. The CMP machine 410 may also have an under-pad 425 between an upper surface 422 of the platen 420 and a lower surface 441 of the planarizing pad 440. In the illustrated embodiment, the platen 420 includes a plurality of transducers 450 proximate to the upper surface 422. Each transducer 450 is configured to vibrate the planarizing pad 440 during planarization. In additional embodiments, the planarizing pad 440 may include the transducers 450 or the transducers 450 may be positioned between the platen 420 and the planarizing pad 440.

From the foregoing, it will be appreciated that specific embodiments of the invention have been described herein for purposes of illustration, but that various modifications may be made without deviating from the spirit and scope of the invention. For example, the planarizing machine can include a computer containing a program or other computer operable instructions that can calculate the frequency of vibration based on the type of slurry (particle size and hardness), the type of work material (work hardness, material stress, etc.), and processing recipe conditions (pressure and relative velocities). Based on these calculations, a frequency is determined, and this frequency is then applied to the transducer by the computer. Accordingly, the invention is not limited except as by the appended claims.

I claim:

1. A machine for polishing a production micro-device workpiece, comprising:

a carrier head for carrying the production micro-device workpiece;

a polishing pad positionable under the carrier head for polishing the production micro-device workpiece;

a transducer configured to produce ultrasonic vibration in at least one of the production workpiece, the polishing pad, and the carrier head; and a controller operatively coupled to the carrier head, the polishing pad, and the transducer, the controller having a computer-readable medium containing instructions to perform a method, comprising:

pressing the production workpiece against the polishing pad and moving the production workpiece relative to the polishing pad; and vibrating at least one of the production workpiece or the polishing pad at an ultrasonic frequency greater than an estimated frequency of serial defects, defined as a number of occurrences per unit of time, in a test workpiece.

2. The machine of claim 1 wherein the transducer is carried by the carrier head and configured to vibrate the production workpiece at the ultrasonic frequency.

3. The machine of claim 1, further comprising a platen coupled to the polishing pad, wherein the transducer is carried by the platen and configured to vibrate the polishing pad at the ultrasonic frequency.

4. The machine of claim 1, further comprising an actuator assembly coupled to the carrier head, wherein the transducer is carried by the actuator assembly and configured to vibrate the production workpiece at the ultrasonic frequency.

5. The machine of claim 1 wherein the transducer is configured to vibrate the production workpiece at the ultrasonic frequency, and wherein the ultrasonic frequency is between approximately 500 kHz and 7 MHz.

6. The machine of claim 1 wherein the transducer is configured to vibrate the production workpiece at the ultrasonic frequency, and wherein the ultrasonic frequency is between 1.1 and 2.0 times the estimated frequency of serial defects in the test workpiece.

7. The machine of claim 1 wherein the transducer is carried by the polishing pad and configured to vibrate the polishing pad at the ultrasonic frequency.

8. A machine for polishing a production micro-device workpiece, comprising:

a table;

a polishing pad on the table;

a carrier head positionable over the polishing pad;

at least one transducer carried by at least one of the table, the polishing pad, and the carrier head to produce ultrasonic motion in at least one of the carrier head, the polishing pad, and the production workpiece; and a controller operatively coupled to the carrier head, the polishing pad, and the transducer, the controller having a computer-readable medium containing instructions to perform a method, comprising:

pressing the production workpiece against the polishing pad and rotating the production workpiece relative to the polishing pad; and moving the production workpiece at an ultrasonic frequency greater than an estimated frequency of serial defects, defined as a number of occurrences per unit of time, in a test workpiece.

9. The machine of claim 8 wherein the transducer is carried by the carrier head and configured to vibrate the production workpiece at the ultrasonic frequency.

10. The machine of claim 8 wherein the transducer is carried by the table and configured to vibrate the polishing pad at the ultrasonic frequency.

11. The machine of claim 8, further comprising an actuator assembly coupled to the carrier head, wherein the transducer is carried by the actuator assembly and configured to vibrate the production workpiece at the ultrasonic frequency.

12. The machine of claim 8 wherein the transducer is configured to vibrate the production workpiece at the ultrasonic frequency, and wherein the ultrasonic frequency is between approximately 500 kHz and 7 MHz.

13. The machine of claim 8 wherein the transducer is configured to vibrate the production workpiece at the ultrasonic frequency, and wherein the ultrasonic frequency is between 1.1 and 2.0 times the estimated frequency of serial defects in the test workpiece.

14. The machine of claim 8 wherein the transducer is carried by the polishing pad and configured to vibrate the polishing pad at the ultrasonic frequency.

15. A machine for polishing a production micro-device workpiece, comprising:

a carrier head for carrying the production micro-device workpiece;

a transducer to generate motion;

a polishing pad positionable under the carrier head for polishing the production micro-device workpiece; and a controller operatively coupled to the carrier head, the transducer, and the polishing pad, the controller having a computer-readable medium containing instructions to perform a method, comprising:

pressing the production workpiece against the polishing pad and moving the production workpiece relative to the polishing pad; and periodically relieving stress between particles in a planarizing solution and the production workpiece by imparting relative motion between the production workpiece and the polishing pad in a direction transverse to a plane defined by the production workpiece at a frequency greater than a predetermined frequency of serial defects, defined as a number of occurrences per unit of time, in a test workpiece.

16. The machine of claim 15 wherein the transducer is carried by the carrier head to impart motion to the carrier head at an ultrasonic frequency.

17. The machine of claim 15, further comprising an actuator assembly coupled to the carrier head and a rod coupled to the transducer and the production workpiece, wherein the transducer is carried by the actuator assembly and configured to vibrate the rod at an ultrasonic frequency.

18. The machine of claim 15 wherein the transducer moves at an ultrasonic frequency, and wherein the ultrasonic frequency is between approximately 500 kHz and 7 MHz.

19. The machine of claim 15 wherein the transducer moves at an ultrasonic frequency, and wherein the ultrasonic frequency is between 1.1 and 2.0 times the predetermined frequency of serial defects.

20. The machine of claim 15 wherein the transducer is carried by the polishing pad and configured to move the polishing pad at an ultrasonic frequency.

21. A machine for polishing a micro-device workpiece, comprising:

a carrier head for carrying the micro-device workpiece;

a transducer to generate motion;

a polishing pad positionable under the carrier head for polishing the micro-device workpiece; and a controller operatively coupled to the carrier head, the transducer, and the polishing pad, the controller having a computer-readable medium containing instructions to perform a method, comprising:

pressing the workpiece against the polishing pad and moving the workpiece relative to the polishing pad; and vibrating at least one of the workpiece or the polishing pad at a frequency greater than an estimated frequency of serial defects, defined as a number of occurrences per unit of time, in the workpiece.

22. The machine of claim 21 wherein the transducer is carried by the carrier head to generate motion at an ultrasonic frequency.

23. The machine of claim 21 wherein the transducer moves at an ultrasonic frequency, and wherein the ultrasonic frequency is between approximately 500 kHz and 7 MHz.

24. The machine of claim 21 wherein the transducer moves at an ultrasonic frequency, and wherein the ultrasonic frequency is between 1.1 and 2.0 times the estimated frequency of serial defects.

* * * * *